US008476611B2

(12) United States Patent
Eisen

(10) Patent No.: US 8,476,611 B2
(45) Date of Patent: Jul. 2, 2013

(54) SYSTEMS AND METHODS FOR THE DETECTION OF ORIENTATION FEATURES ON A MATERIAL WEB

(75) Inventor: Juergen Eisen, Augsburg (DE)

(73) Assignee: Texmag GmbH Vertriebsgesellschaft, Thalwil (CH)

( * ) Notice: Subject to any disclaimer, the term of this patent is extended or adjusted under 35 U.S.C. 154(b) by 721 days.

(21) Appl. No.: 12/370,335

(22) Filed: Feb. 12, 2009

(65) Prior Publication Data

US 2009/0206284 A1 Aug. 20, 2009

Related U.S. Application Data

(60) Provisional application No. 61/041,297, filed on Apr. 1, 2008.

(30) Foreign Application Priority Data

Feb. 19, 2008 (EP) ..... 08151610

(51) Int. Cl.
*G01N 21/86* (2006.01)
*G01V 8/00* (2006.01)

(52) U.S. Cl.
USPC ..... 250/559.29; 250/559.36; 250/559.4; 356/237.2

(58) Field of Classification Search
USPC .. 250/559.29, 559.3, 559.36, 559.4; 356/615, 356/429, 237.2, 237.3, 237.4, 237.5, 237.6
See application file for complete search history.

(56) References Cited

U.S. PATENT DOCUMENTS

| | | | | |
|---|---|---|---|---|
| 5,354,992 | A | 10/1994 | Thompson et al. | |
| 6,566,670 | B1 * | 5/2003 | Buisker et al. | 250/559.36 |
| 6,743,337 | B1 * | 6/2004 | Ischdonat | 162/198 |
| 7,202,492 | B2 | 4/2007 | Inhelder et al. | |
| 7,719,696 | B1 * | 5/2010 | Nakayashiki | 356/614 |
| 2004/0149940 | A1 | 8/2004 | Buisker | |
| 2006/0027767 | A1 | 2/2006 | Inhelder et al. | |
| 2006/0170910 | A1 * | 8/2006 | Almogy et al. | 356/237.1 |

FOREIGN PATENT DOCUMENTS

| | | |
|---|---|---|
| DE | 19653312 | 4/1998 |
| DE | 10352274 | 6/2004 |
| EP | 1300353 | 4/2003 |
| EP | 1300354 | 4/2003 |
| EP | 1 623 943 | 2/2006 |
| WO | WO 2005090212 A1 * | 9/2005 |

OTHER PUBLICATIONS

EPO Search Report for Application No. 08151610.6 dated Jan. 22, 2009.
EPO Search Report for Application No. 08151610.6 dated Jul. 23, 2008.
Certified translation of Foreign Patent Publication No. DE 10352274.
Office Action for Application No. CN200910008008.1, issued May 12, 2010, English Translation, 6 pages.
Office Action for Application No. CN200910008008.1, issued Apr. 8, 2011, English Translation, 8 pages.
Office Action for Application No. CN200910008008.1, issued Mar. 28, 2012, English Translation, 8 pages.
Office Action for Chinese Application No. CN200910008008.1, issued Oct. 30, 2012, with English Translation (19 pages).

* cited by examiner

*Primary Examiner* — Francis M Legasse, Jr.
(74) *Attorney, Agent, or Firm* — Fish & Richardson P.C.

(57) ABSTRACT

This application relates to systems and methods for the detection of orientation features on a material web.

28 Claims, 5 Drawing Sheets

SYSTEMS AND METHODS FOR THE DETECTION OF ORIENTATION FEATURES ON A MATERIAL WEB

CROSS-REFERENCE TO RELATED APPLICATIONS

This application claims priority under 35 U.S.C. §119 to European Patent Application No. EP08151610.6, filed Feb. 19, 2008, the contents of which are hereby incorporated by reference in its entirety, and under 35 U.S.C. §119 to U.S. Provisional Patent Application No. 61/041,297, filed on Apr. 1, 2008, the contents of which are hereby incorporated by reference in its entirety.

FIELD OF APPLICATION

This application relates to systems and methods for the detection of orientation features on a material web.

BACKGROUND

During the handling and processing of web-shaped materials, guiding controls for webs are deployed. Material webs, for instance, can be fed into a machine, processed and subsequently rewound by using a winding device, whereby various positioning errors may occur. In order, for example, to guide the lateral offset of a material web, appropriate control devices can be used.

FIG. 1A and FIG. 1B show such a regulating device, in which the material web 100 of a width B, assisted by a steering frame system, experiences a four-time diversion of 90 degrees each. The material web 100 is deflected by an infeed roller 101, and with an inlet length $L_1$ fed into a pivoting frame 105 with two guide rollers 102, 103. A lateral adjustment of the material web can be effected by using a pivoting frame 105. The material web is then pivoted at pivot point 106 around an angle $\alpha$. With an outlet length $L_2$ the material web is then fed into outfeed roll 104. In the range of outlet length $L_2$ a sensor device 170 may be arranged. Due to the pivoting of the material web around an angle $\alpha$, the material web may, in the area of outlet length $L_2$, show a respective deviation from a predetermined material web level S.

This deviation can influence the measuring result of a sensor that is located in the area of the outlet length. In an embodiment for a web guiding control an additional roller may be located in the area of the outlet length, in order to adjust the deviation and hold the material web in the further course of the outlet length on its predetermined material web level S. Thus a constant gap distance from the material web to the sensor may be kept in the further course of the outlet length, and a precise measurement of the material web with conventional sensors made possible. However, the material web may be warped or wrinkled by the support roller. The use of an additional roller may also be cost-intensive.

SUMMARY

This application relates to systems and methods for the detection of orientation features on a material web.

Disclosed, for example, are devices and methods for the detection of at least one orientation feature on a material web, which runs on a predetermined material web level in the predetermined travel direction of the material web.

In terms of one aspect the device involves a sensor device, including a sensor element with at least one sensor line for the registration of a sensor zone on the material web. Additionally, the device involves at least one light transmitter to produce a beam spot on the material web, in order to determine the position of a material web level that shows a deviation from the predetermined material web level. Thus, in some embodiments, the position of the deviating material web level can be determined in a simple and cost-saving way, and a simple and precise detection of at least one orientation feature can be made possible.

The device may show one or more of the following features in various embodiments. The material web level that shows a deviation from the predetermined material web level may be a material web level turned around its axis running in the travel direction of the material web. The light transmitter (at least one) can be developed in such a way that the beam spot (at least one) in the sensor zone lies on the material web. The sensor device can be developed in a way that the sensor element registers the (at least one) light beam on the material web to determine the position of the deviating material web level. The light transmitter can be developed in order to produce at least two beam spots on the material web. In this case the light transmitter can, additionally, be developed in such a way that at least two light spots on the material web are preferably in a line, which runs vertically to the predetermined travel direction of the material web. The light transmitter can be developed in such a way that the (at least two) light spots on the material web along the predetermined material web level show a first distance. Additionally, the light transmitter can be developed in such a way that the (at least two) light spots on the material web along the deviating material web level show a second distance. In such a case the sensor device can be developed in such a way that the sensor element registers the first and second distance to determine the position of the deviating material web level. The device may involve appliances to analyze the difference between the first and second distance in order to determine the position of the deviating material web level. The light transmitter can be developed in such a way that (at least two) light beams that run parallel to each other are being created which produce (at least two) light spots on the material web. For this purpose the device can involve (at least two) light transmitters that are arranged parallel to each other. In some embodiments, the device may involve one light transmitter and a beam divider arrangement in order to produce the (at least two) light spots on the material web. The beam divider arrangement may involve a semi-transparent element and a reflecting element. The sensor can be developed in such a way that (at least two) sensor lines of the sensor element in the direction of the material web will be readout, at least partially, thus to achieve an integration effect at the sensor zone of the material web in the travel direction of the material web. The sensor element can be arranged in a slanted position toward the predetermined material web level.

In terms of another aspect the device involves a sensor device, which includes a sensor element with at least two sensor lines, for the registration of a sensor zone on the material web. The sensor device has been developed in a way that at least two sensor lines of the sensor element in the direction of the material web are being readout at least partially. Thus an integration effect at the sensor zone of the material web in the travel direction of the material web may be achieved. The use of additional integration devices for the widening of the sensor zone in the direction of the material web may generally not be required. In addition the number and scope of the sensor lines, the partial section of the sensor lines to be readout, may be chosen flexibly.

The device may show one or more of the following features in various embodiments. The sensor device can be developed in such a way that only a partial section of the sensor lines of the sensor element is being readout at least in part. In particular the sensor can be developed in such a way that 1/10 or less of the sensor lines of the sensor element will be readout at least in part. The sensor device can be developed in such a way that the sensor element can be readout at a frequency between 50 and 1000 Hz, in particular at approximately 200 Hz. The material web level that shows a deviation from the predetermined material web level may be a material web level turned around its axis running in the travel direction of the material web. The device may involve at least one light transmitter to produce at least one light spot on the material web to determine the position of the material web level deviating from the predetermined material web level. The sensor device can be developed in such a way that the sensor lines of the sensor element in a sensor zone will be readout in the periphery of the (at least) one light spot. The sensor element can be arranged in a slanted position toward the predetermined material web level. In this case the sensor device can be developed in such a way that the partial section of the sensor lines depends on the position of the deviating material web level.

In terms of a further aspect the device involves a sensor device which includes a sensor element with at least two sensor lines for the registration of a sensor zone on the material web, whereby the sensor element is arranged in a slanted position toward the predetermined material web level. As a result a partial section of the sensor lines to be readout can be selected dependent on the position of the material web level. This may make autofocusing possible without the use of additional focusing appliances.

The device may show one or more of the following features in various embodiments. The sensor device can be developed in such a way that at least two sensor lines of the sensor element will be readout in the travel direction of the material web at least partially, so to achieve an integration effect at the sensor zone of the material web in the travel direction of the material web. The sensor device can be developed in such a way that only the partial section of the sensor lines of the sensor element will be readout at least partially. The material web level that shows a deviation from the predetermined material web level may be a material web level turned around its axis running in the travel direction of the material web. In addition, the device may involve at least one light transmitter to produce at least one light spot on the material web to determine the position of the material web level deviating from the predetermined material web level. The sensor device can be developed in such a way that the partial section of the sensor lines depends on the position of the deviating material web level.

In addition, in terms of one or all of the aspects named above, the device may show one or several of the following features. The light transmitter (at least one) can be a monochromatic light source, for example, a laser. Furthermore the device may include an optical element, for example, a lens, which is to be arranged between the sensor element and the material web. In some embodiments, the sensor device can be developed in such a way that the magnification ratio of the sensor device can be larger than 1:2.

The device may further involve a focusing element, which is arranged between the sensor element and the material web. The focusing element can be developed in such a way that it will change the optical element, depending on the determined position of the deviating material web. The (at least one) orientation feature can be a line or a pattern on the material web. The (at least one) orientation feature may also be an edge of the material web. The sensor device can be developed in a way that the sensor element will detect differences in brightness and/or color of at least one orientation feature. Moreover, the sensor element can also be a CMOS matrix sensor.

In terms of one aspect the method includes detecting of a sensor zone on the material web by using a sensor device, which includes a sensor element with at least one sensor line, generating at least one light spot on the material web by using at least one light transmitter, and determining the position of the material web level deviating from the predetermined material web level by using at least one light spot.

In terms of a further aspect the method comprises detecting a sensor zone on the material web by using a sensor device, which includes a sensor element with at least two sensor lines, and reading readout at least two sensor lines of the sensor element at least partially in the travel direction of the material web to achieve an integration effect in the sensor zone on the material web in the travel direction of the material web.

The embodiments may provide any, all or none of the following advantages. Through utilization of at least one light transmitter, in order to produce at least one light spot on the material web, the position of a deviating material web level may be determined in a simple and cost-saving way. Thus, in some embodiments, a simple and precise detection of at least one orientation feature on the material web may be made possible. With the readout of at least two sensor lines of the sensor element in the travel direction of the material web an integration effect may be achieved. The use of additional integration devices for the widening of the sensor zone in the direction of the material web may generally not be needed. In addition the number and scope of the sensor lines, the partial section of the sensor lines to be readout, may be chosen flexibly. By arranging the sensor element in a slanted position toward the predetermined material web level, the partial section of the sensor lines to be readout can be selected depending on the position of the material web level. This may make autofocusing possible without the use of additional focusing appliances.

BRIEF DESCRIPTION OF THE DRAWINGS

Following is an explanation based on exemplary embodiments with reference to the attached drawings.

DETAILED DESCRIPTION

In a device, e.g., for controlling the lateral offset of a material web, at least one orientation feature can be used to determine a lateral deviation of the material web from a predetermined position. This can be at least one orientation feature, for instance a line or a pattern on the material web. The orientation feature may run in the travel direction of the material web and can be located near the edge of the material web or be the edge itself. The sensor elements in this case can be optoelectronic sensors, such as color sensors or cameras.

Figure 1A:
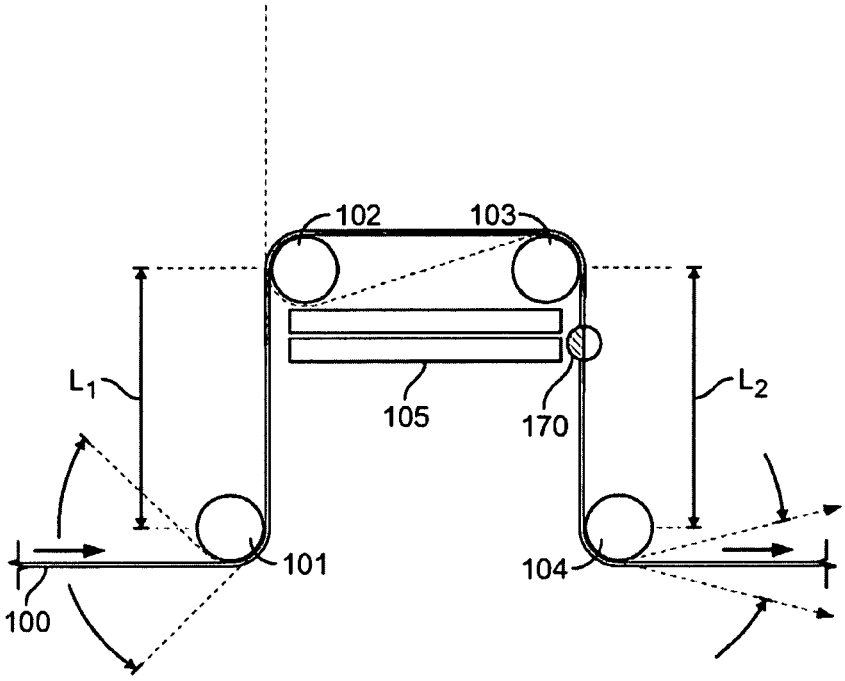
FIG. 1A is a lateral view of a device that may used to control the lateral offset of a material web.
Figure 1B:
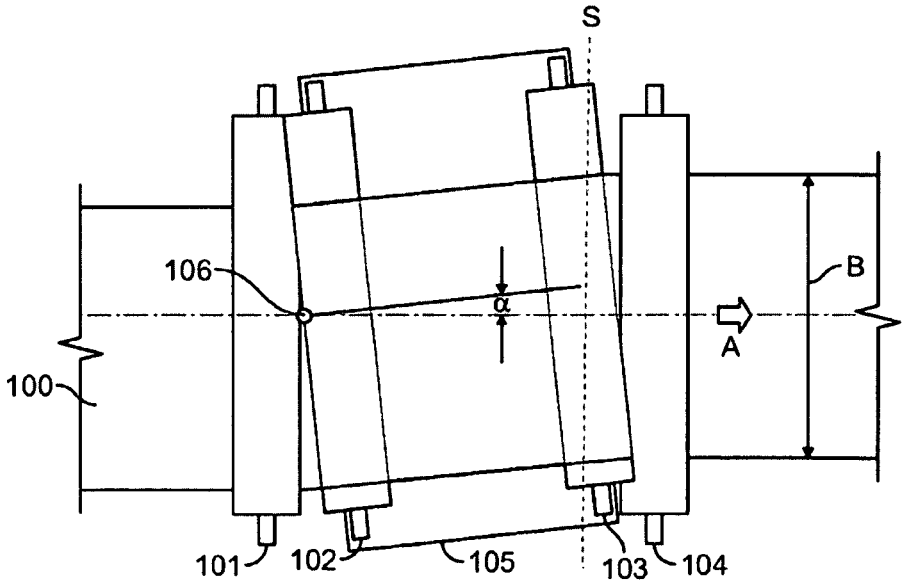
FIG. 1B is a top view from above on a device that may be used to control the lateral offset of a material web as per FIG. 1A.
Figure 2B:
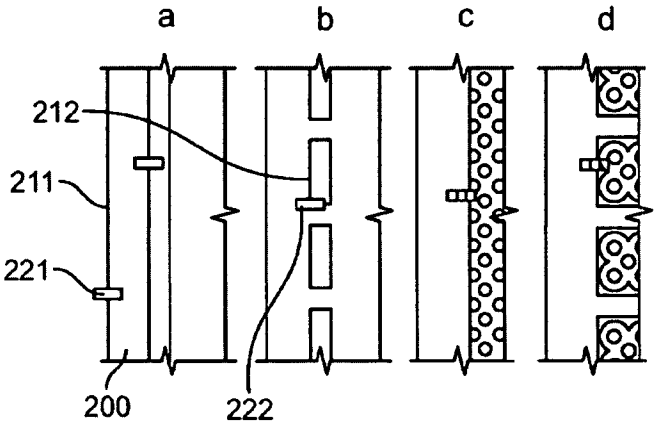
FIG. 2B is a perspective view of material webs, which shows a difference in contrast as an orientation feature.
Figure 2A:
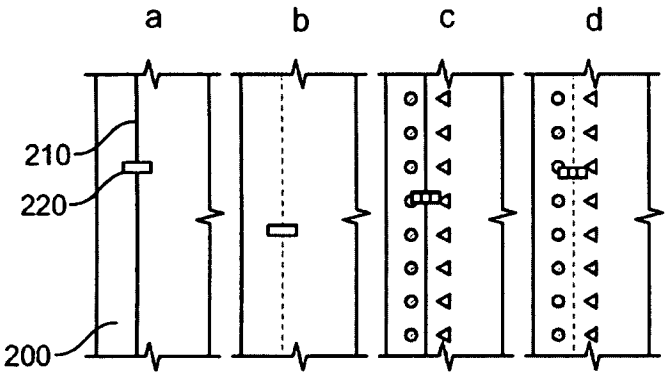
FIG. 2A is a perspective view of material webs, which shows one line as an orientation feature.

FIG. 2A illustrates material webs which show a line as orientation feature. In FIG. 2A a) a line 210 on material web 200 is being sampled in a sensor zone 220. FIG. 2A a) and c) illustrate, in each case, continuous lines with an even background or a disturbed background, respectively. In FIG. 2A b) and d), in each case, broken (or dashed) lines with an even background or a disturbed background, respectively. The device should also be suitable for detecting the orientation feature with a "busy" or disturbed background.

The (at least one) orientation feature can, for example, also be an edge of a material web or something similar. FIG. 2B a) illustrates a material web 200, whose edge 211 is sampled in a sensor zone 221. The orientation feature, i.e. the edge, is thus detectable by the sensor device as a difference in contrast. In some embodiments, the sensor device can detect differences in brightness and/or color. In such embodiments the contrast can be calculated correspondingly. In FIG. 2B orientation features continue to be illustrated as differences in contrast. FIG. 2B a) and c) illustrate, in each case, continuous contrast edges with an even background or a disturbed background, respectively. In FIG. 2B b) and d), in each case, broken contrast edges with an even background or a disturbed background, respectively can be seen.

If the subsequent description does not specify anything to the contrary, the sensor element may thus have the following embodiments. For instance, the sensor element can be a CCD sensor or a CMOS sensor. The sensor element can be a line sensor, such as a CCD line sensor. The sensor element may, however, also be a matrix sensor, such as a CCD matrix sensor or a CMOS matrix sensor.

The sensor element can be a black & white camera or a monochrome camera. The sensor element may also be a color sensor, registering pixel by pixel, which may use an RGB evaluation. With each sampling the light is broken down in the basic colors red (R), green (G) and blue (B). With the aid of an algorithm the differences in contrast may then be evaluated by a calculation unit, such as a processor, and the position of the orientation feature may be displayed. The contrast, as mentioned above, can also be calculated from the differences in brightness.

Figure 3:
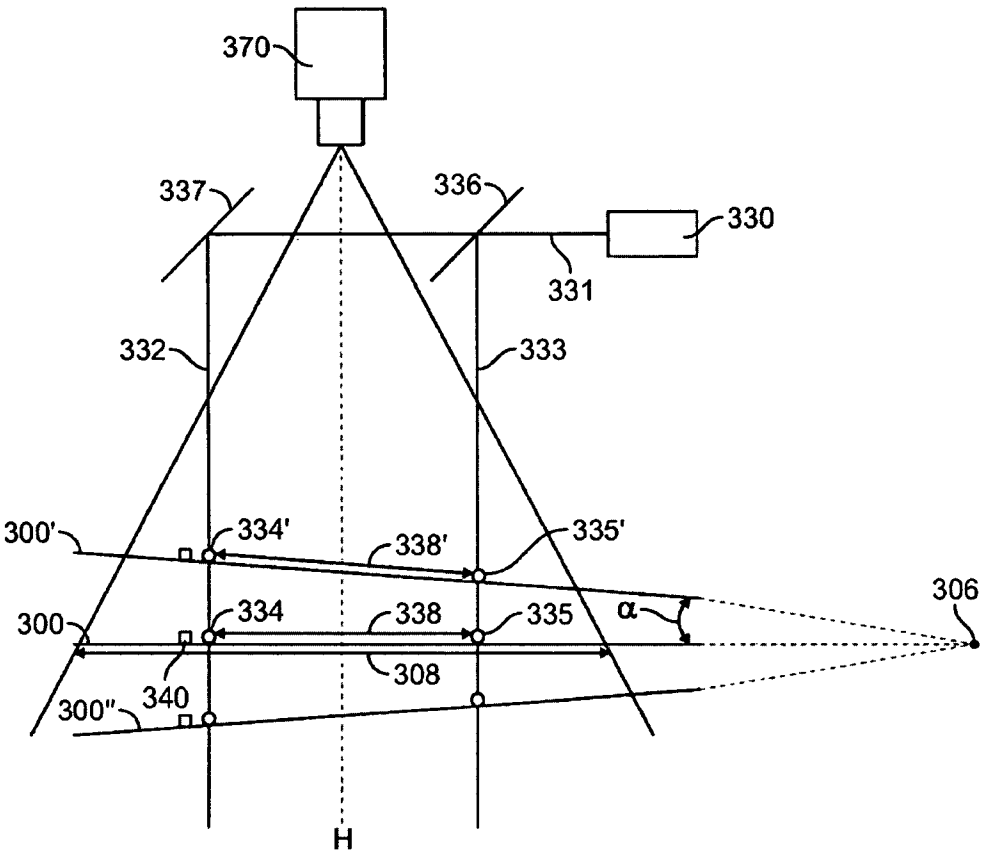
FIG. 3 is a schematic sectional view of a device that may be used to detect at least one orientation feature on a material web, which involves a light transmitter.

FIG. 3 is a schematic sectional view of a device that may be used to detect at least one orientation feature 340 on a material web 300, which involves a light transmitter 330. The device further involves a sensor device 370, which includes a sensor element with at least one sensor line for the registration of a sensor zone 308 on the material web. The material web 300 runs on a predetermined material web level in a predetermined travel direction of the material web (into the drawing plane or, respectively, out of it). If the material web is offset, the material web may thus run on a material web level which deviates from the predetermined material web level. In FIG. 3 the material web is pivoted along the angle $\alpha$ around a pivot point 306. The material web 300' then runs on a deviating material web level, which is a material web level that runs along an axis that is turned in the travel direction of the material web, a material web level that is turned along an axis that runs through pivot point 306. Correspondingly a material web pivoted in the opposite direction has been illustrated in FIG. 3 as material web 300".

When determining the position of the orientation feature 340 on the material web, the position of the orientation feature 340 can be registered within the sensor zone 308. If the material web, as shown in FIG. 3, for example, is offset by the deviating material web 300', the sensor zone and the position of the orientation feature therefore change. This could result in an error when measuring the position of the orientation feature 340. After determining the position of the deviating material web level, however, this error may generally only be compensated by appropriate calculations. For this purpose the light transmitter 330 creates a light beam 331, producing two light spots 334, 335 on the material web 300. In the process the light spots 334, 335 in the sensor zone 308 lie on the material web 300 and can be detected by the sensor device 370. In FIG. 3 the two parallel light beams 332, 333 are aligned in parallel and symmetrically to the principal axis H of the object lens of the sensor device 370. To determine the position of the deviating material web level 300' (or respectively 300") the sensor device 370 may then register the two light spots 334', 335' on the material web 300'. In doing so, the two light spots 334, 335 (or respectively 334', 335') lie on the material web 300 (or respectively 300') in one line, which runs vertically to the predetermined travel direction of the material web, that is to say one line in the drawing plane of FIG. 3. On the material web 300 that runs on the predetermined material web level, the two light spots 334, 335 show a first distance 338. On the material web 300' that runs on the deviating material web level, the two light spots 334', 335' show a second distance 338'. To determine the position of the deviating material web level 300' the sensor element of the sensor device 370 can register the first and second distance. Furthermore, to then determine the position of the deviating material web level 300', the difference between the first distance 338 and the second distance 338' can be evaluated, for instance with evaluation tools which may be located in the sensor device or as well outside of it. These evaluation tools may be used to produce a signal that indicates the position of the deviating material level.

To produce the two light spots 334, 335 (or respectively 334', 335') two light beams 332, 333 running parallel to each other are shown in FIG. 3. The light transmitter 330 emits light beam 331, which is split up into two parallel light beams 332 and 333 through a beam divider arrangement 336, 337. The beam divider arrangement hereby involves the semi-transparent element 336 and the reflecting element 337. In some embodiments, this beam division into two parallel light beams may be carried out in a precise and cost-efficient manner, although high production accuracy may be used for arranging the beam dividers. Splitting the light beam can be achieved by other examples of beam division as well, such as a prism. In some embodiments, for the production of the two light beams the device may as well involve two light transmitters that may be arranged parallel to each other.

Determining the position of the deviating material web level may be achieved with only one light spot as well. Determining the position of the deviating material web may, for example, then be made by triangulation. It should be equally understood that several (more than the two as illustrated in FIG. 3) light spots may be produced in order to determine the position of the deviating material web level. It should be understood that any other detectable form, such as a line of light, can be detected.

Figure 4:
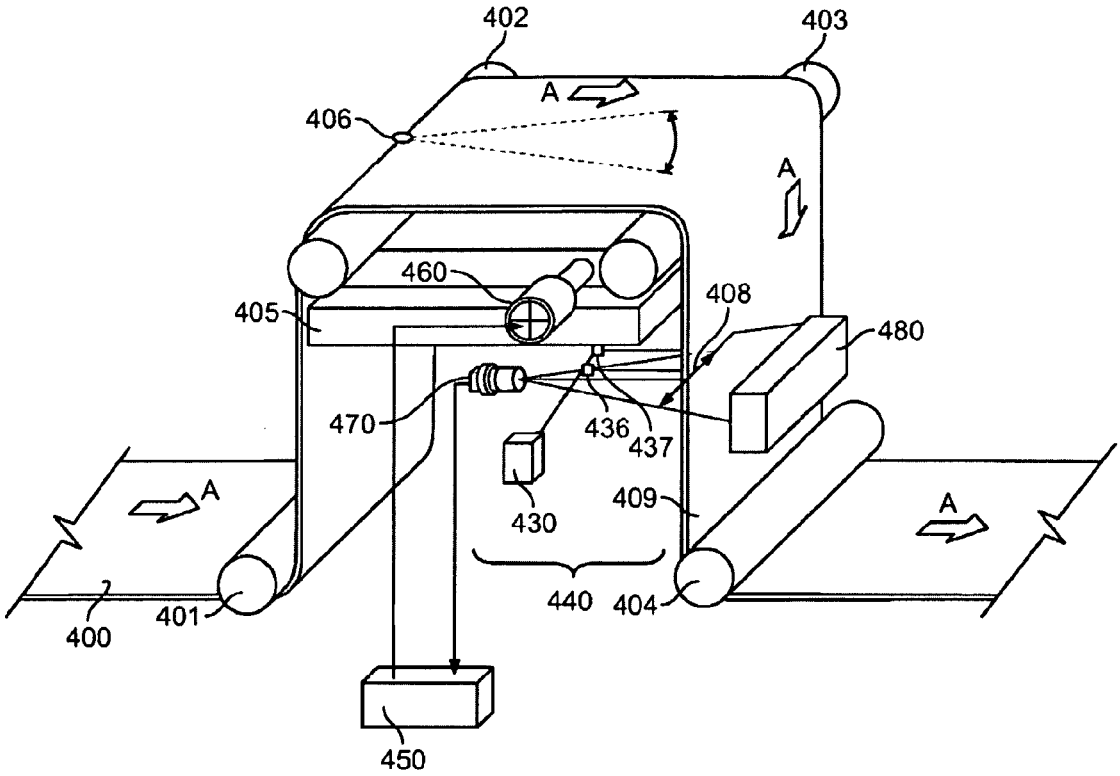
FIG. 4 is a three-dimensional view of a device that may be used to control the lateral offset of a material web with a device that may be used to detect at least one orientation feature on a material web, which involves a light transmitter.

FIG. 4 is a three-dimensional view of a device that may be used to control the lateral offset of a material web 400 with a device 440 that may be used to detect at least one of the orientation features on the material web 400. The material web 400 experiences a four-time diversion of 90 degrees each via the rollers 401, 402, 403, and 404. By use of a pivoting frame 405, powered by a drive device 460, such as an actuator, a lateral adjustment of the material web can be brought about. The material web is hereby pivoted around pivot point 406 at a particular angle. The material web is then, via an outlet length, fed into outfeed roll 404. In the range of the outlet length, device 440 is located for the detection of at least one orientation feature on the material web 400. In this case, the (at least one) orientation feature may be, for instance, the edge of material web 409 and/or a line located near the edge of the material web in the travel direction A of the material web. In FIG. 4 the detection of at least one orientation feature, through the direct light-method, is effected by using a light source 480, which is arranged on an opposite side of the sensor device 470 of the material web 400. The device can also involve more than one light source for different web surfaces. It should be understood that the device can work with incident light or other appropriate arrangements as well, but also when there may be no additional light source at all.

The sensor device 470 involves the sensor zone 408 on the material web 400 in order to detect the (at least one) orientation feature there. If the material web 400, in the range of the outlet length, by pivoting at a particular angle around pivot point A, is brought off the predetermined travel level of the material to a deviating material web level, then the distance between the material web and the sensor element 470 is no longer constant. This deviating position of the material web may now be determined by using light transmitter 430. The light transmitter 430, with the aid of beam divider arrangement 436, 437, may create two parallel beams that produce two light spots in the sensor zone 408 on the material web 400. The position of the deviating material web level may be determined in an easy and cost-saving manner, and a simple and precise detection of at least one orientation feature on the material web may be made possible.

The distance of the two light spots can be registered by the sensor device 470. A corresponding signal can then be given by the sensor device 470 to the controlling device 450. The controlling device, considering the signal, may then determine the lateral offset of the material web 400 and may actuate the drive device 460 accordingly.

The light transmitter 330 can be a monochromatic light source, for example, a laser. Other appropriate light transmitters, however, can be used as well. If a laser is being sent out, the laser may be switchable. In this case the sensor device can register the sensor zone at a first point in time, when the light transmitter is switched off and no light spots are present. At a second point in time the sensor device can register the sensor zone when the light transmitter is switched on and the light spots in the sensor zone are present. Then the difference between the data records of the first and second point in time can be sampled. Thus the recognizability of the spots on the material web may be improved.

Figure 5:
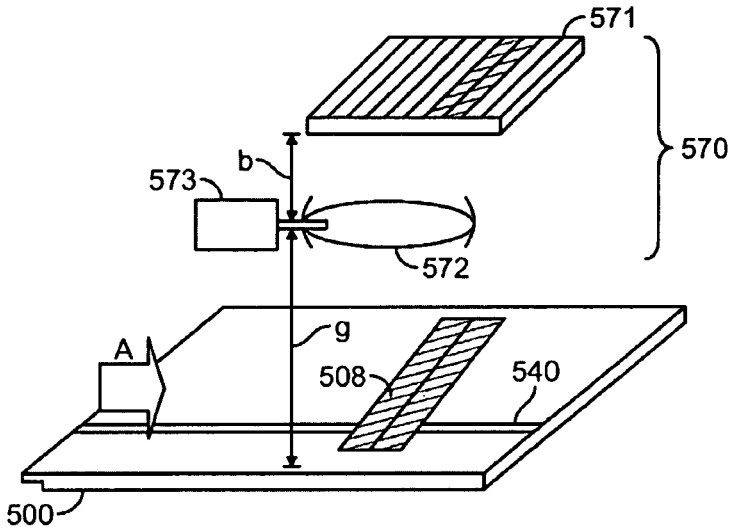
FIG. 5 is a schematic sectional view of a device that may be used to detect at least one orientation feature with a straight alignment of the sensor element.

FIG. 5 is a schematic sectional view of at least a part of a device that may be used to detect an orientation feature 540 on a material web 500. The sensor device 570 registers a sensor zone 508 on the material web 500. For the illumination of the material web a light source (not illustrated) can be used. The incident light beams into the sensor device 570 may be focused by an optical element, the lens 572, which is arranged between the sensor element 571 and the material web 500, and come upon the sensor element 571. This optical element may also represent the object lens. In FIG. 5, the sensor element 571 has been aligned in a straight position, so that the sensor element 571 has been aligned parallel to the predetermined material web level. The sensor element 571 has furthermore been aligned vertically and symmetrically to the principal axis of the object lens. The sensor element 571, as illustrated in FIG. 5, involves at least two sensor lines, and is therefore a matrix sensor element. The sensor element 571 may be, for example, a CMOS matrix sensor.

With the sensor device 570 as shown in FIG. 5, at least two sensor lines of the sensor element 571 in the travel direction A of the material web may be, at least partially, above all, however, completely, readout, to achieve an integration effect in the sensor zone 508 on the material web 500 in travel direction A of the material web. Only a partial section of the sensor lines of the sensor element 571 may be readout. That is, only some of the sensor lines of the sensor element 571 may be readout and/or only portion(s) of individual sensor line(s) of the sensor element 571 may be readout. Therefore, the widening of the sensor zone in the travel direction of the material web may occur without the use of additional integration devices. In addition, the number and scope of the sensor lines, the partial section of the sensor lines to be readout, may be chosen flexibly. In particular, 1/10 or less of the sensor lines of the sensor element 571 may be readout. If all sensor lines were readout for a sampling, the sampling rate would be very low and the procedure thus very slow. The sensor element, for instance, can be readout at a frequency between 50 and 1000 Hz only, in particular at approximately 200 Hz. Merely as an example a CMOS matrix sensor with a number of pixels of 2500×1950 is being stated. If a possible readout frequency was 200 Hz and the sampling, that is, the image, consisted of 30 lines, it would result in a sampling rate of 6 samples per second. The size of an image with some 30 sensor lines lies in the range of about one 1/100 of the 2,500 (or respectively 1,950) available sensor lines.

The material web 500 can, by using an offset device, be offset to a material web level that deviates from the predetermined material web level, as previously illustrated. The device may also further involve a light transmitter to produce at least one light spot on the material web in order to determine, as previously illustrated, the deviating material web level. The sensor lines of the sensor element 571 in a sensor zone 508 in the periphery of the (at least) one light spot can then be readout.

The magnification ratio of the sensor device 570 can be larger than 1:2. Our magnification ratio is to be understood as the ratio between image distance b and object distance g. Here the image distance can be the distance between the sensor element 571 and the optical element 572. The object distance g can be the distance between the material web 500 and the optical element 572. A magnification ratio larger than 1:2 results in the object distance g being more than twice as large as the image distance b. The magnification ratio can be in a range of 1:4 to 1:10.

The device may further involve a focusing element 573, which is arranged between the sensor element 571 and the material web 500. The focusing element may involve a piezo-element, for instance. With its help, the optical element 572, for example, can be offset in a direction parallel to the principal axis of the object lens, and can thus effect a focusing by changing the image sharpness. The magnification ratio is thus being changed as well.

In case of a deviation of the material web from the predetermined material web level, the focusing element 573 can change the optical element, the lens 572, depending on the determined position of the deviating material web. Especially in the sensor device 570, as illustrated in FIG. 5, a light transmitter (not illustrated) may be used for determining the deviating material web level, as illustrated with reference to FIGS. 3 and 4. With the help of light spots being produced in this way, or light spots on the material web, an autofocusing may then be possible, depending on the respective position of the deviating material web level.

Figure 6:
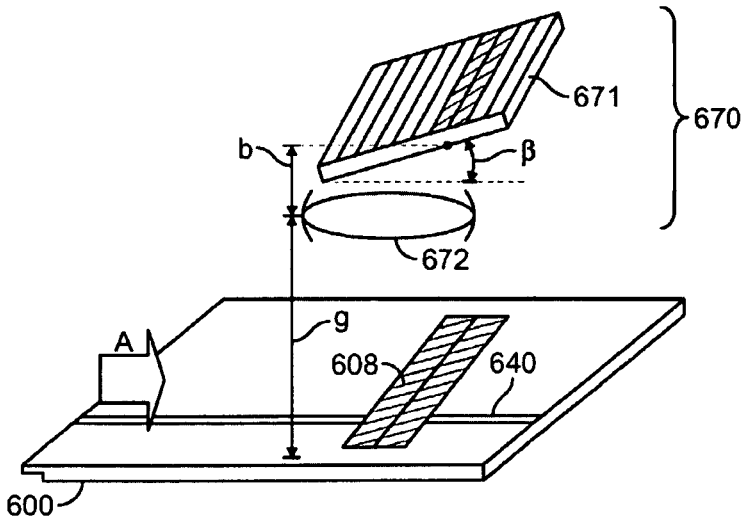
FIG. 6 is a schematic sectional view of a device that may be used to detect at least one orientation feature with a slanted alignment of the sensor element.

FIG. 6 is a schematic sectional view of device 670 for the detection of at least one orientation feature 640 on a material web 600. Unlike FIG. 5, the sensor element 671 is here arranged in a slanted position toward the predetermined material web level, such that the sensor element 671 is arranged on a level that forms angle β (where β is not equal to zero) with the predetermined material web level. Here the sensor element 671 is not aligned on a plane that is perpendicular to the principal axis of the object lens. If the material web is offset by an offset device on a material web level that deviates from the predetermined material web level, a partial section of the sensor lines, depending on the position of the deviating material web level, can be determined and readout. Thus an autofocusing without the use of additional focusing appliances may be made possible. For the determining of the position of the deviating material web a light transmitter can be used, as illustrated with reference to FIGS. 3 and 4.

It should be understood that the various aspects illustrated with reference to FIG. 3 to 6 may be combined in any meaningful way. For example, for the device, as illustrated in FIG. 3, at least two sensor lines of the sensor element can be readout, at least in part, in the travel direction of the material web with a light transmitter, so to achieve an integration effect in the sensor zone on the material web in the travel direction of the material web. The sensor element of the device as per FIG. 3 can also be arranged in a slanted position toward the predetermined material web level.

What is claimed is:

1. A device comprising:

a sensor device comprising:

an optical sensor element having at least one sensor line and being configured and disposed to detect, within a sensor zone of the sensor device, at least one orientation feature of a material web and at least one light beam spot on the material web while the material web is being fed in a predetermined travel direction through the sensor zone of the sensor device;

at least one light transmitter configured and disposed to produce the at least one light beam spot on the material web while the material web is being fed in the predetermined travel direction through the sensor zone of the sensor device; and a controller configured to determine:

based on the detection of the at least one orientation feature of the material web, a deviation of the material web within a plane of the material web in the sensor zone of the sensor device; and based on the detection of the at least one light beam spot on the material web, a deviation of the plane of the material web in the sensor zone of the sensor device from a desired material web level.

2. The device of claim 1, wherein the deviation of the plane of the material web from the desired material web level comprises a rotation of the material web about an axis running in the predetermined travel direction.

3. The device of claim 1, wherein the at least one light beam spot comprises at least two light beam spots.

4. The device of claim 1, wherein the at least one sensor line of the optical sensor element comprises multiple sensor lines; and wherein the sensor device is configured to read out, at least partially, at least two sensor lines of the multiple sensor lines of the optical sensor element in order to achieve an integration effect at the sensor zone in the predetermined travel direction.

5. The device of claim 1, wherein the at least one orientation feature comprises at least one of a line on the material web, a pattern on the material web, or an edge of the material web.

6. The device of claim 1, wherein the sensor device is configured such that the optical sensor element detects a difference in at least one of brightness or color of the at least one orientation feature.

7. The device of claim 1, wherein the optical sensor element is arranged in a slanted position relative to the desired material web level.

8. The device of claim 1, wherein the sensor element is arranged in a plane that forms a nonzero angle with the desired material web level.

9. The device of claim 1, wherein the at least one light transmitter comprises a monochromatic light source.

10. The device of claim 1, wherein the optical sensor element comprises a CMOS matrix sensor.

11. A system comprising:

a roller subsystem configured to allow movement of a material web in a predetermined travel direction of the material web; and the device of claim 1.

12. The device of claim 3, wherein the at least one light transmitter is configured and disposed such that the at least two light beam spots are arranged in a line, the line running perpendicular to the predetermined travel direction.

13. The device of claim 3, wherein the at least two light beam spots comprise a first light beam spot and a second light beam spot; and wherein the at least one light transmitter is configured and disposed such that the first and second light beam spots are arranged along the desired material web level and spaced apart by a first distance.

14. The device of claim 3, wherein the at least one light transmitter is configured and disposed to generate at least two light beams that run parallel to each other, the at least two light beams producing the at least two light beam spots.

15. The device of claim 3, wherein the at least one transmitter comprises at least two light transmitters that are arranged parallel to each other.

16. The device of claim 3, wherein the at least one transmitter comprises one light transmitter; and wherein the device further comprises:

a beam divider arrangement configured and disposed to produce the at least two light beam spots.

17. The device of claim 13, wherein the at least two light beam spots further comprise a third light beam spot and a fourth light beam spot; and wherein the at least one light transmitter is configured and disposed such that the third and fourth light beam spots are arranged along a web level deviating from the desired material web level and spaced apart by a second distance.

18. The device of claim 17, wherein the optical sensor element is configured and disposed to register the first and second distances and the controller is configured to determine the deviation of the plane of the material web from the desired material web level based on at least the first and second distances.

19. The device of claim 18, wherein the device further comprises:

an element configured to analyze a difference between the first and second distances in order to determine the deviation of the plane of the material web from the desired material web level.

20. The device of claim 19, wherein the sensor device further comprises the element.

21. The device of claim 16, wherein the beam divider arrangement comprises:

a semi-transparent element; and a reflecting element.

22. The device of claim 4, wherein the at least two sensor lines comprise less than all of the multiple sensor lines of the optical sensor element.

23. The device of claim 4, wherein the at least two sensor lines comprises all of the two sensor lines of the optical sensor element.

24. The device of claim 4, wherein the at least two sensor lines comprises a partial section of at least one of the at least two sensor lines.

25. The device of claim 9, wherein the monochromatic light source comprises a laser.

26. A method comprising:

probing, using a sensor device, a sensor zone of the sensor device to detect at least one orientation feature of a material web and at least one light beam spot on the material web, the sensor device comprising an optical sensor element having at least one sensor line, the material web being fed at a material web level in a predetermined travel direction through the sensor zone of the sensor device;

producing the at least one light beam spot on the material web using at least one light transmitter;

determining, based on the detection of the at least one orientation feature of the material web, a deviation of the material web within a plane of the material web in the sensor zone of the sensor device; and determining, based on the detection of the at least one light beam spot on the material web, a deviation of the plane of the material web in the sensor zone of the sensor device from a desired material web level.

27. A device comprising:

a controller;

a sensor device comprising:

an optical sensor element having at least one sensor line and being configured and disposed to probe a sensor zone of the sensor device and detect at least one orientation feature on the material web and at least one light beam spot on the material web while the material web is being fed in a predetermined travel direction through the sensor zone of the sensor device; and at least one light transmitter configured and disposed to produce at least a first light beam spot, a second light beam spot, a third light beam spot, and a fourth light beam spot on the material web while the material web is being fed in the predetermined travel direction through the sensor zone of the sensor device, wherein the at least one light transmitter is configured and disposed such that the first and second light beam spots are arranged along a desired material web level separated by a first distance in the sensor zone of the sensor device;

wherein the at least one light transmitter is configured and disposed such that the third and fourth light beam spots are arranged along a web level deviating from the desired material web level and spaced apart by a second distance in the sensor zone of the sensor device; and wherein the optical sensor element is configured and disposed to register the first and second distances and the controller is configured to determine, based on at least the first and second distances, the deviation of a plane of the material web level from the desired material web level in the sensor zone of the sensor device.

28. A method comprising:

registering, using a sensor device, a sensor zone of the sensor device to detect at least one orientation feature of a material web and at least one light beam spot on the material web, the sensor device comprising an optical sensor element having at least one sensor line, the material web being fed at a material web level in a predetermined travel direction through the sensor zone of the sensor device;

producing the at least a first light beam spot, a second light beam spot, a third light beam spot, and a fourth light beam spot on the material web using at least one light transmitter, the first and second light beam spots being arranged along a desired material web level spaced apart by a first distance in the sensor zone of the sensor device, the third and fourth light beam spots being arranged along a web level deviating from the desired material web level and spaced apart by a second distance in the sensor zone of the sensor device; and registering the first and second distances using the optical sensor element;

determining, based on at least the first and second distances, the deviation of a plane of the material web from the desired material web level in the sensor zone of the sensor device.

* * * * *